United States Patent [19]

Kuno

[11] Patent Number: 4,841,269

[45] Date of Patent: Jun. 20, 1989

[54] COIL DEVICE

[75] Inventor: Kazuo Kuno, Kobe, Japan

[73] Assignee: Mitsubishi Denki Kabushiki Kaisha, Japan

[21] Appl. No.: 278,450

[22] Filed: Dec. 1, 1988

[51] Int. Cl.[4] ..... H01F 5/00

[52] U.S. Cl. ..... 335/299; 336/223

[58] Field of Search ..... 335/296, 299; 336/192, 336/223, 225

[56] References Cited

FOREIGN PATENT DOCUMENTS

| | | | |
|---|---|---|---|
| 1290248 | 5/1964 | Fed. Rep. of Germany | 335/299 |
| 1491786 | 7/1967 | France | 335/299 |
| 43504 | 3/1984 | Japan | 335/299 |

*Primary Examiner*—George Harris
*Assistant Examiner*—S. Mackey
*Attorney, Agent, or Firm*—Leydig, Voit & Mayer

[57] ABSTRACT

Disclosed is a coil device having feeders which are connected to a power source and which are adapted to supply electric current, a coil conductor section which is connected at both ends to these feeders and wound into a coil in a position adjacent to the feeders, and dents formed in at least one of the coil conductors of the coil conductor section at positions in the vicinity of the feeders in such a manner as to generate current loops which cancel the error magnetic field generated by the error magnetic field current loop of the feeders.

5 Claims, 4 Drawing Sheets

COIL DEVICE

BACKGROUND OF THE INVENTION

This invention relates to a coil device, and in particular, to a coil device used as the helical coil, the toroidal coil, the poloidal coil, the charged particle accelerator, etc. of a fusion experiment apparatus.

FIGS. 1 to 4 show examples of conventional coil devices, in particular with respect to the structure of the current feeding sections thereof. FIG. 1 shows the structure of a standard-type coil. In the structure shown in FIG. 2, the thickness of the coil feeder 3 is less than that of the coil conductor 2 so that the error magnetic field generated by the coil feeder can be diminished. The structures shown in FIGS. 3 and 4, which are disclosed in Japanese Patent Laid-Open No. 53-134405, are improvements of those shown in FIGS. 1 and 2. In these drawings, the coil 1 is composed of coil conductors 2 and feeder 3. Electric current flows in the direction indicated by the arrow 4. The feeder 3 includes in the corner thereof slits 5. In order to generate the required magnetic field, electric current is passed through the coil conductor 2 from the feeder 3.

When performing such operations as the trapping or controlling of plasma, or the deflecting of charged particles using the magnetic field generated by a conventional coil device of this type, any "disturbance in the magnetic field", which is generally called an error magnetic field, can have a bad influence on the trapping or controlling of plasma or on the deflection of charged particles. It is consequently necessary to diminish this error magnetic field as much as possible. The winding and arrangement of the coil conductor must accordingly be very accurate. Moreover, this makes it necessary to prevent the magnetic field generated by the feeder lead section from having a bad influence on the normal magnetic field generated by the coil conductor section.

In the case of the structure shown in FIG. 1, the electric current required for generating the magnetic field is a circular current. When the ideal circular current is removed from the actual current including the current flowing through the feeders 3, the current component shown by the closed curves (a) in FIG. 5 remains. This current component constitutes the error magnetic field current loop which causes an error magnetic field to be generated.

The conventional coil device shown in FIG. 1 involves a large error magnetic field loop, which can have a bad influence on such device functions as plasma trapping. The structure shown in FIG. 2, which is an improvement of the structure shown in FIG. 1, also involves a similar error field current loop, so that it cannot be applied to a device of which a high magnetic field accuracy is required.

In the feeder 3 of the structure shown in FIGS. 3 and 4, in a top and a perspective view, respectively, the current distribution adjustment is effected by means of slits 5. As shown in FIG. 6, the error magnetic field current loops generated in this structure are relatively small. Further, these current loops generaged are in the directions opposite to each other (i.e., one is clockwise and the other counterclockwise), thus canceling each other. However, electric current is concentrated in the slit sections 5 of the feeder section, raising the temperature of these slit sections due to the Joule effect. In addition, the strength of this structure is exceedingly inadequate because of the slits 5, so that it cannot be applied to a coil device on which great magnetic force is exerted.

SUMMARY OF THE INVENTION

This invention aims at overcoming the above-mentioned problems and at providing a coil device which generates a small error magnetic field, further the feeder section of which presents no problems in terms of strength and thermal properties.

In the feeder section of the coil device in accordance with this invention, dents are formed in the coil conductors at positions in the vicinity of the feeders.

In this invention, the electric current path is changed by providing dents in the coil conductor in the vicinity of the feeder, thereby canceling the error magnetic field generated by the feeders.

DESCRIPTION OF THE PREFERRED EMBODIMENTS

Figure 7:
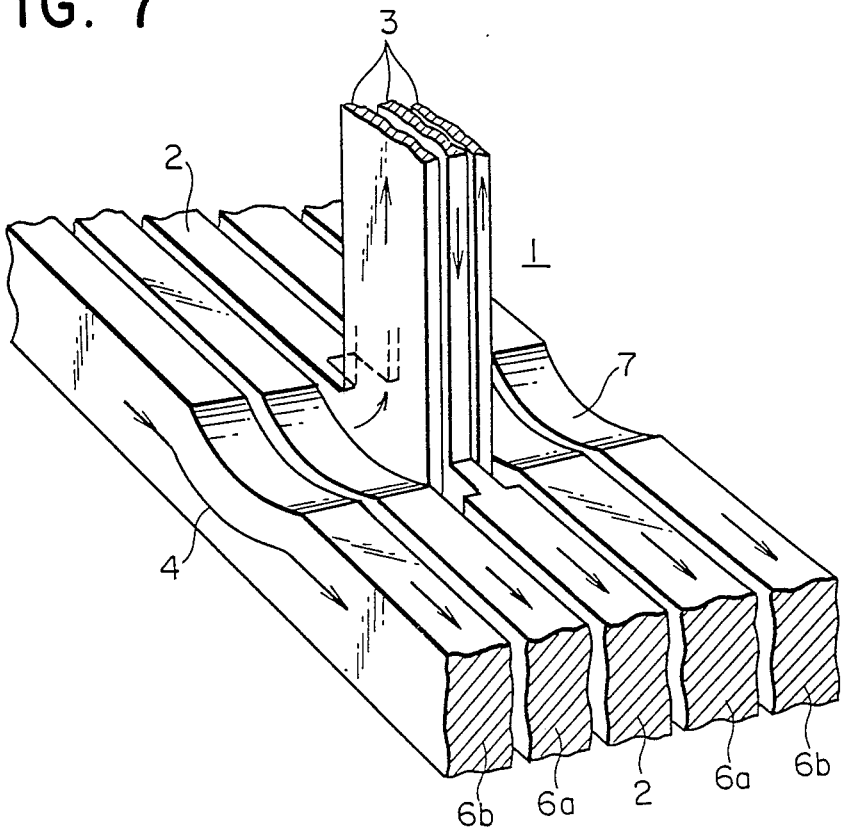
FIG. 7 is a perspective view showing the structure of the section around the feeder section of a coil device in accordance with an embodiment of the present invention.

FIG. 7 shows an embodiment of the feeder structure of a coil device in accordance with this invention. As shown in the drawing, dents 7 are formed in the coil conductors **6*a* and 6*b* adjacent to the feeder section 3. The components which are identical with those of the conventional coil devices shown in FIGS. 1 to 4** have the same reference numerals.

Figure 8:
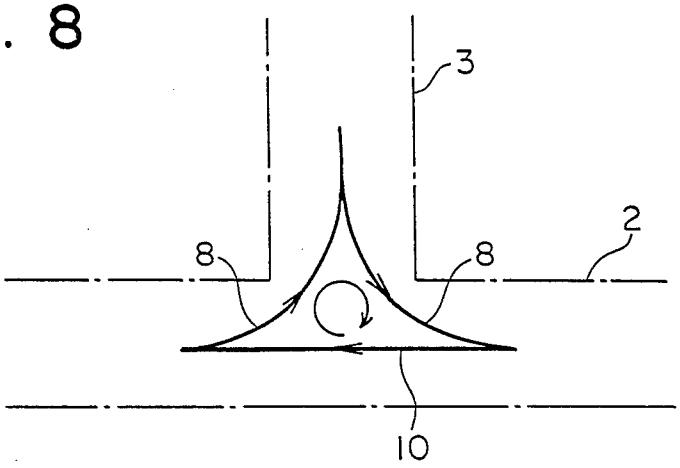
FIG. 8 illustrates the error magnetic field current loop in the feeder section shown in FIG. 7.

In the above-described construction, the electric current flowing through the coil conductors 2 and the feeders 3 forms the error magnetic field current loop shown in FIG. 8. This error magnetic field current loop is generated by the actual current 8 and a current component 10 which is obtained by subtracting the ideal current from the actual current.

Figure 9:
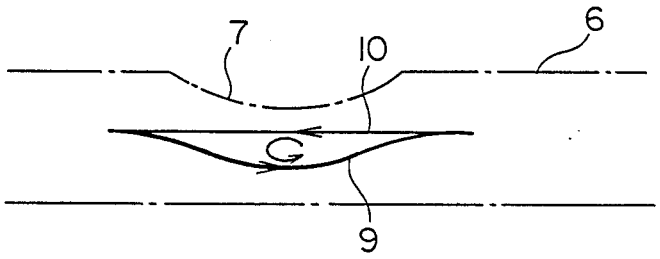
FIG. 9 illustrates the error magnetic field current loop generated in the vicinity of a dent formed in the coil conductor.

The path of the current flowing through the coil conductors **6*a* and 6*b* is bent by the dents 7. FIG. 9 shows the error magnetic field current loop generated by the current 9 flowing through the conductors 6***a* and 6*b* and the current component 10 which is obtained by subtracting the ideal current from the actual current. The error magnetic field current loops shown in FIGS. 8 and 9 are in the opposite directions with respect to each other, and the directions of the error magnetic fields generated are accordingly different from each other. It is consequently possible to adjust through the depth of the dents 7 the magnitude of the error magnetic field which is generated by the error magnetic field current loop of FIG. 9 in such a manner that the error magnetic field generated by the error magnetic field current loop shown in FIG. 8 and that shown in FIG. 9 cancel each other, thus making it possible to diminish the error magnetic field to an exceptional degree.

Figure 1:
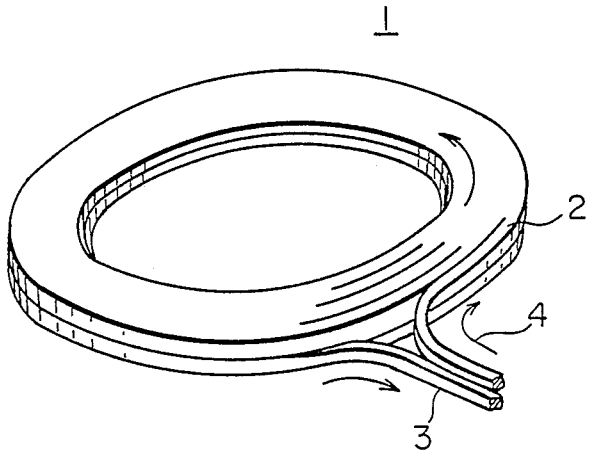
FIG. 1 PRIOR ART
FIG. 1 is a perspective view of a conventional coil device.
Figure 2:
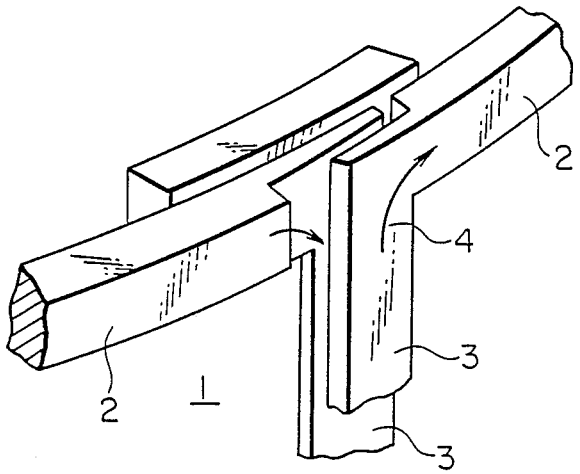
FIG. 2 PRIOR ART
FIG. 2 is a perspective view showing an example of the structure of the section around the feeder section of a conventional coil device.
Figure 3:
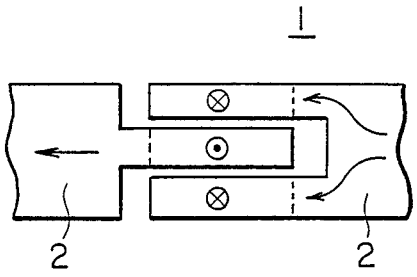
FIG. 3 PRIOR ART
FIG. 3 is a top view of another example of the structure of the section around the feeder section of a conventional coil device.
Figure 4:
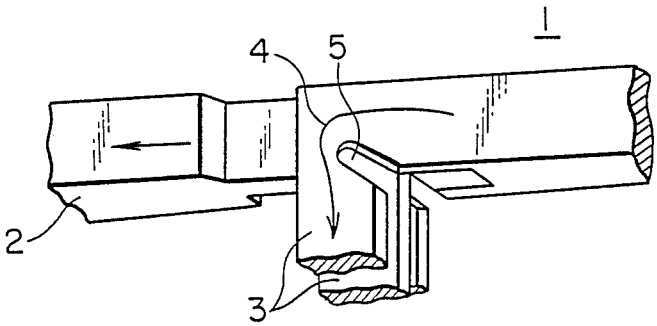
FIG. 4 PRIOR ART
FIG. 4 is a perspective view of the feeder section shown in FIG. 3.
Figure 5:
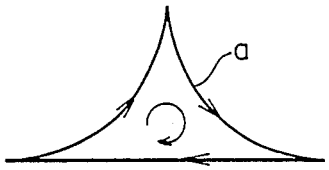
FIG. 5 PRIOR ART
FIG. 5 illustrates an error magnetic field current loop generated in a conventional coil device.
Figure 6:
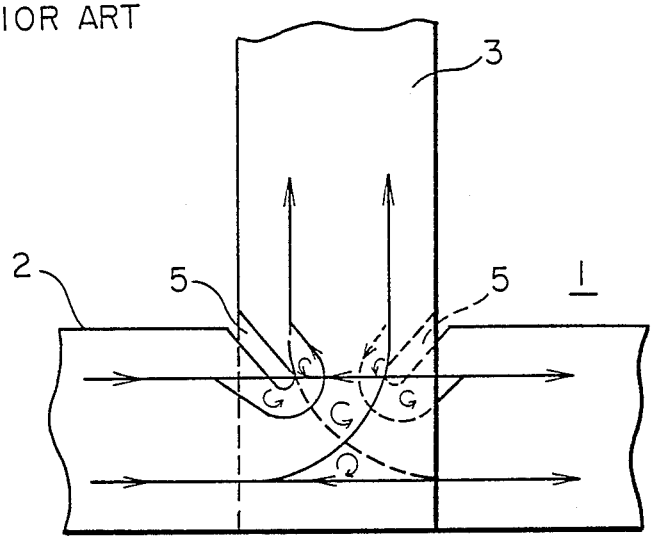
FIG. 6 PRIOR ART
FIG. 6 illustrates an error magnetic field current loops generated in conventional coil device of the type having slits in the feeder section.

Since the structure shown in FIG. 7 does not include any slits 5 as does that shown in FIG. 4, the strength of the feeder section 3 is improved, and the current concentration is mitigated, so that the temperature rise due to the Joule effect can be kept as low as possible.

The decrease in strength and the temperature rise due to the presence of the dents 7 in the conductors 6*a* and 6*b* adjacent to the feeder section are moderate enough when compared with those in the feeder section, so that they do not constitute any serious defects of the device.

While in the embodiment shown in FIG. 7 the dents 7 have an arc-like configuration, they may also have a shallow, boat-like form composed of arc-like sections and linear sections. The decrease in strength and the temperature rise mentioned above can then be kept as moderate as possible.

Further, while in the above embodiment the feeder section has a sandwich-like structure and the dents 7 are formed in the four conductors 6*a* and 6*b* adjacent to the feeder section, the structure of the feeder section and the configuration of the dents are not to be constructed as restructed to those of the above embodiment. A number of variations may be conceived in this regard.

Figure 10:
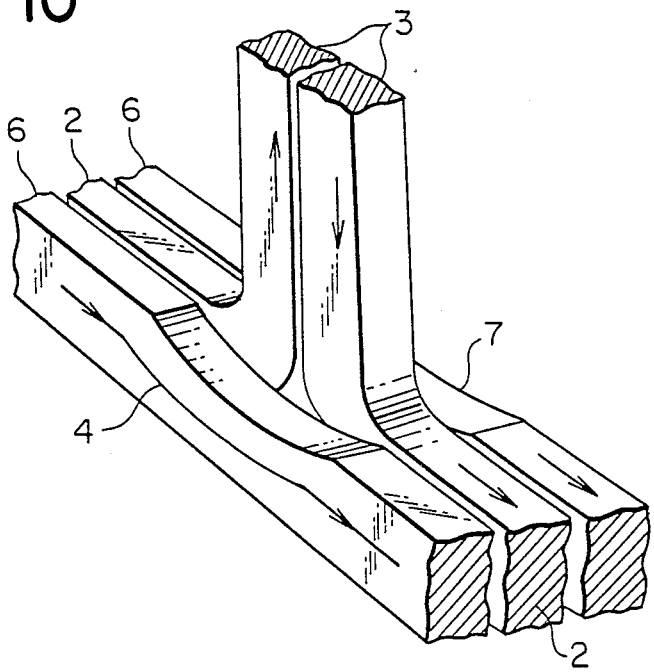
FIG. 10 is a perspective view showing the structure of the section around the feeder section of a coil device in accordance with another embodiment of this invention.

FIG. 10 shows another embodiment of this invention. As shown in the drawing, the embodiment has two feeders as in the conventional devices, and dents 7 are fromed on both sides of the coil conductors 6. It is of course possible to impart the structure shown in FIG. 2 to the feeder section of this embodiment. Further, the error magnetic field diminishing effect can also be obtained by forming the dent in only one of the conductors.

As described above, in accordance with this invention, the error magnetic field generated by the error magnetic field current loop of the feeder section is canceled by the error magnetic field current loop generated in the dent sections of the coil conductors. A coil device which does not involve a large error magnetic field and whose feeder section is free from defects in terms of strength and thermal properties can thus be provided.

What is claimed is:

1. A coil device comprising:

feeders connectable to a power source and adapted to supply electric current;

a coil conductor section connected at both ends to said feeders and wound into a coil in a position adjacent to said feeders; and deformed sections provided in at least one of the coil conductors of said coil conductor section at positions in the vicinity of said feeders in such a manner as to generate current loops which cancel an error magnetic field generated by a current loop which flows in said feeders.

2. A coil device as claimed in claim 1, wherein said deformed sections consist of dents formed on that side of said coil conductors to which said feeders are connected.

3. A coil device as claimed in claim 2, wherein the profile of said dents has an arc-like configuration.

4. A coil device as claimed in claim 2, wherein the profile of said dents has a boat-like form composed of arc sections and linear sections.

5. An electrical coil apparatus comprising:

a coil conductor wound into a coil having a plurality of turns;

current feeder conductors connected to said coil conductor for supplying an electric current to said coil, said feeder conductors extending substantially radially outwardly from said coil at a position adjacent to at least one of said turns and generating a first error magnetic field;

said coil conductor having a shallow notch on its radially outward surface of a coil conductor section that is located axially adjacent to said feeder conductors for generating a second error magnetic field effective for canceling out said first error magnetic field generated by said feeder conductors.

* * * * *